United States Patent [19]

Hidding

[11] 4,369,901

[45] Jan. 25, 1983

[54] SNAP-UP COVER FOR SPICE DISPENSER

[76] Inventor: Walter E. Hidding, Rte. 2, Wood Rock Rd., Barrington Hills, Ill. 60010

[21] Appl. No.: 240,893

[22] Filed: Mar. 5, 1981

[51] Int. Cl.[3] ..... A47G 19/24

[52] U.S. Cl. ..... 222/480; 222/151; 222/483; 222/543; 222/142.7

[58] Field of Search ..... 220/335, 339; 222/142.1, 142.6, 142.7, 151, 482, 483, 498, 485, 517, 543, 545, 556, 565, 153, 480

[56] References Cited

U.S. PATENT DOCUMENTS 3,217,949 11/1965 Davis ..... 222/480

3,262,606 7/1966 Waterman ..... 222/153

FOREIGN PATENT DOCUMENTS 335816 3/1959 Switzerland ..... 222/142.7

345645 9/1929 United Kingdom ..... 222/142.6

*Primary Examiner*—David A. Scherbel

*Attorney, Agent, or Firm*—John S. Fosse

[57] ABSTRACT

A unitary closure for a spice dispenser includes a spooning cap and a sifter cap which are provided with respective protuberances and niches which cooperate in an overcentering arrangement for positively locking either cap in the fully opened, upright condition and concomitantly preventing both caps from being raised at the same time.

5 Claims, 4 Drawing Figures

SNAP-UP COVER FOR SPICE DISPENSER

FIELD OF THE INVENTION

This invention relates generally to consumer packaged products and more particularly to dispenser/containers for household use of such pulverulent products as dry, powdered condiments.

BACKGROUND OF THE INVENTION

Early spice containers were simple metal boxes with a scored aperture in the top panel which could be punched out with a spoon or other kitchen implement. Once opened, these packages readily allowed the volatile spice essences to escape; and as a result, the shelf-life of the contents was notably limited.

With the advent of plastics technology, a rapid series of improvements in spice container design ensued. One of these designs is disclosed in U.S. Pat. No. 3,217,949 granted to one George M. Davis. The Davis Patent describes a domestic spice container which includes a plastic closure comprising a flap for sealing a spoon opening and a separate flap for sealing a sifter opening. This closure is intended to be mounted atop a container body by means of an integral hinge section situated between the flaps.

BRIEF DESCRIPTION OF THE INVENTION

I have discovered that the device of the Davis Patent is subject to serious drawbacks. For example, in use, both closure flaps can be raised at the same time with a consequent potential for dispensing excessive and wasteful amounts of the spice. In addition, the springiness of the plastic material of the closure biases the flaps away from the fully open condition, thus hindering easy spooning or sifting. I have therefore provided a flap-type spice can closure with an overcentering arrangement that positively locks the selected closure flap in the fully open position and concomitantly prevents both flaps from being raised at the same time.

Accordingly, a general object of the present invention is to provide a new and improved spice can arrangement.

Another object of my invention is to provide a spice container closure that promotes both ease of dispensing and security in use.

These and other objects and features of the present invention will become apparent from a consideration of the following disclosure and drawing forming a part thereof.

DETAILED DESCRIPTION OF THE DISCLOSED EMBODIMENT

Figure 1:
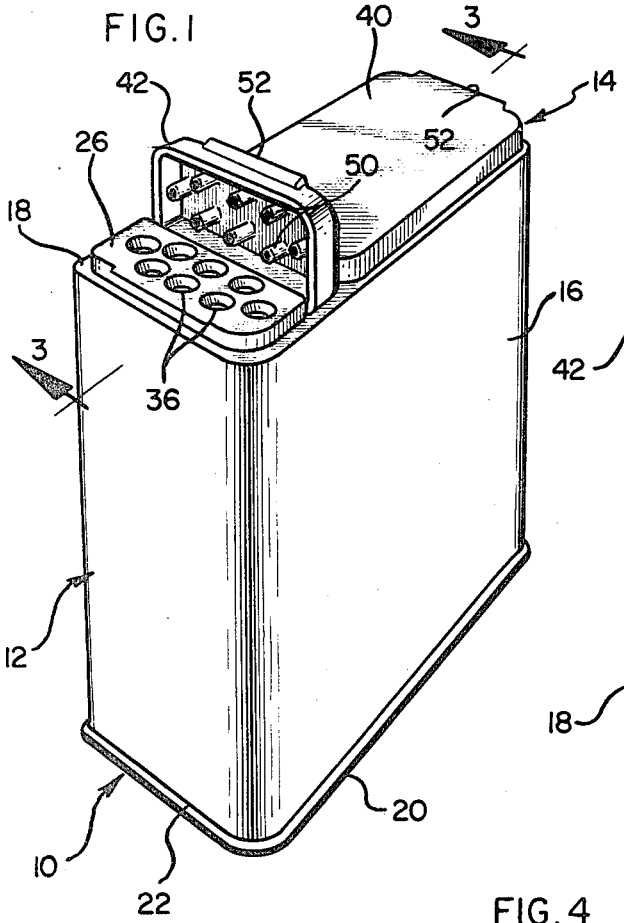
FIG. 1 is a perspective view of a household spice dispenser assembled with a closure in accordance with the principles of the present invention.

Referring now in detail to the drawing, specifically to FIG. 1, a package indicated generally by the reference numeral 10 is arranged for storing and dispensing household quantities of dry, powdered spices and generally comprises a container-dispenser 12 and a closure 14. The closure 14 is advantageously fabricated as a unitary element from a suitable, molding grade thermoplastic resin, such as polyethylene; and the container 12 may be constructed as either a two-piece or three-piece part from a similar resin, from tinplate or from a composite.

Figure 2:
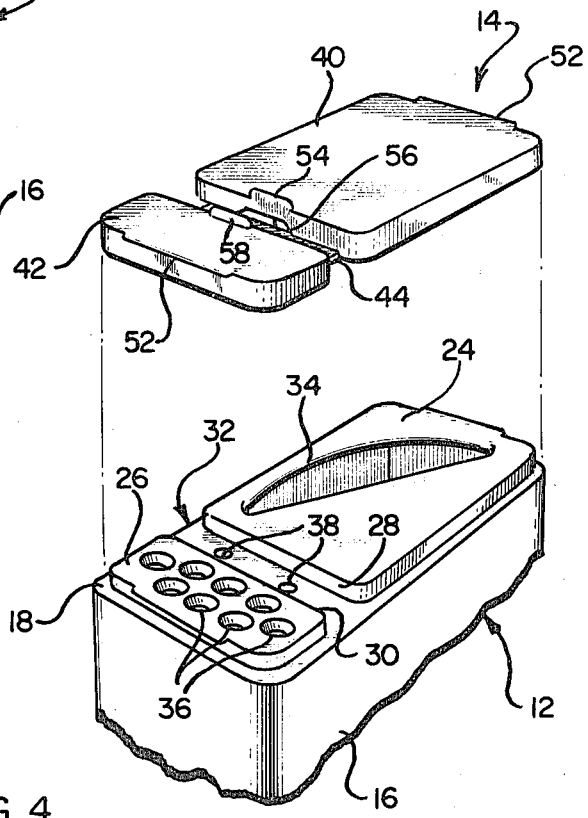
FIG. 2 is a fragmentary perspective view similar to the showing of FIG. 1 but illustrating the closure exploded from the dispenser body.

Continuing with reference to FIG. 1 and with additional reference to FIG. 2, the container 12 is comprised of a hollow, rectangularly tubular body 16 which is closed at its opposite ends with a top 18 and a bottom 20. In the illustrated embodiment, the bottom 20 comprises a rimmed metal panel which is seamed on the body 16 by means of a clinched bead 22; and the top 18 includes a raised spooning platform 24 and a cooperating, raised sifter platform 26, the platform 24 and the platform 26 having respective, confronting walls 28 and 30 which define between them a parallel sided valley 32. In addition, the platform 24 is perforated with a pendantly skirted, sector-shaped spooning opening 34 whereas the platform 26 is inlet with a plurality of sifter holes 36 which are provided with tapered, conical sidewalls. The top 18 may be formed integral with the body 16 or it may be sonically welded thereto as is desired. Furthermore, the floor of valley 32 is perforated with stud-receiving apertures 38 for purposes which will become more apparent hereinafter.

Figure 4:
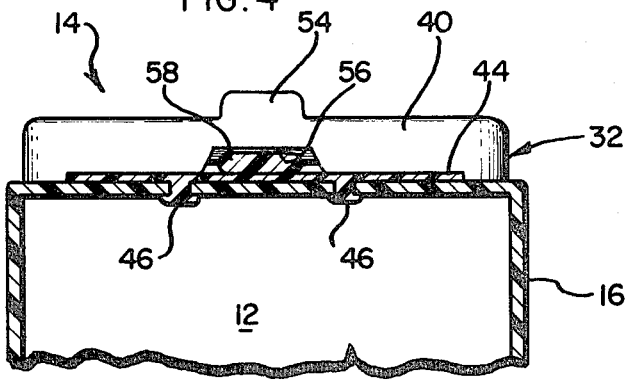
FIG. 4 is a transverse cross-sectional view taken substantially along the line 4—4 of FIG. 3.
Figure 3:
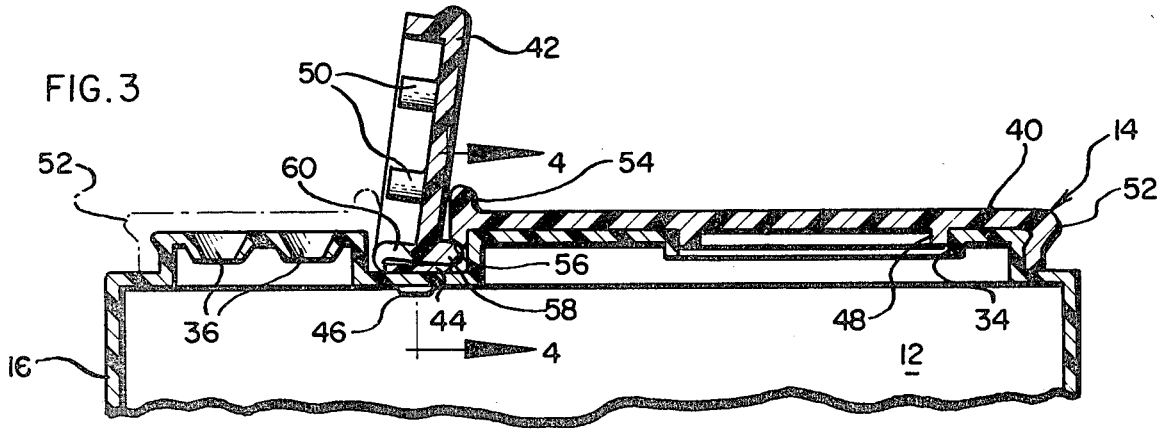
FIG. 3 is an enlarged central cross-sectional view taken substantially along the line 3—3 of FIG. 1.

The closure 14 comprises a rectangularly convex spooning cap 40 and a generally similarly shaped but smaller sifting cap 42 which are dimensioned for snap-fit engagement over the respective platforms 24 and 26. In addition, a flat strap 44 hingedly interconnects the caps 40 and 42 to fittably engage the floor of valley 32. As is shown in FIGS. 3 and 4, a pair of studs 46 depend from the strap 44 to enter the apertures 38 so that their free ends may be headed over to fasten the closure 14 securely to the container 12. As is best seen in FIG. 3, the spooning cap 40 is fashioned with a pendant, internal skirt 48 which sealably fits in the spooning opening 34. Correspondingly, the sifter cap 42 is provided with a plurality of tubular posts 50 which sealably penetrate the tapered holes 36 in the closed condition of the cap 42. Conveniently, each of the caps 40 and 42 includes an outwardly extending lifter bar 52 which affords purchase for a fingernail or kitchen tool in elevating the respective caps from the closed to the open condition.

In compliance with the features of the present invention, the closure 14 is provided with an overcentering arrangement that positively locks either of the caps 40 and 42 in the fully open, upright position and concomitantly prevents both caps from being raised at the same time. Structurally, the spooning cap 40 is provided with an upstanding snap-fit protuberance 54 which extends from the edge of the cap adjacent the valley wall thereof, as is shown in FIGS. 2–4. In addition, the cap 40 is provided with a niche 56 situated in the valley wall of the cap generally at the root of the valley floor in the corresponding valley wall. Cooperatively, an upstanding snap-fit protuberance 58 is arranged to extend from the edge of sifting cap 42 adjacent the valley wall thereof and in alignment with the spooning cap niche 56. The sifter cap 42 is also provided with a niche 60 in the valley wall thereof aligned with the protuberance 54 on the spooning cap 40. The protuberances 54 and 58 are selected to be bar-shaped tongues and the niches 56 and 60 are arranged to be elongate recesses into which the respective tongues may be selectively snap-fit. As will be seen in the various figures of the drawings, the protuberances 54 and 58 and the niches 56 and 60 are aligned perpendicular to the sagittal plane of the dispenser body 16. Moreover, the height of the confronting valley walls of the caps 40 and 42 is made substantially equal to the width of the valley floor along the strap 44 in order that raising of one of the caps serves to lock the remaining cap over its corresponding dispenser body platform. So arranged, only one of the sifter and spooning platforms can be revealed at one time, thus preventing inadvertent and unwanted dispensing of the package contents.

Continuing with reference to FIGS. 1, 3 and 4, when it is desired to sift or shake the package contents through the sifter holes 36, for example, the user will pry the cap 42 upwardly employing the purchase provided by the bar or ridge 52. As the cap swings on the hinge defined by strap 44, the protuberance 58 will initially encounter the interference of protuberance 54 and the corresponding valley wall of cap 40. As the cap 42 continues to swing, the protuberance 58 will overcenter and snap into the niche 56 in the valley wall of cap 40 whereby to lock the cap 42 in the upright position shown in FIGS. 1 and 3. After a suitable quantity of the powdered contents have been extracted through the sifter holes 36, it is only necessary to reverse the procedure and snap the cap 42 back over the platform 26, the posts 50 entering the tapered bores of the holes 36 to preclude egress of either the powdered contents or the volatile essences thereof.

The cap 40 may similarly be raised into a positively located or locked upright condition for spooning of the spice contents through the sector-shaped opening 34.

The drawing and the foregoing descriptions are not intended to represent the only forms of my invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated in the following claims.

The invention is claimed as follows:

1. In a closure to be assembled with a dispenser for dry powdered spice products, the dispenser including a hollow body having a spooning platform and a sifting platform at the top end, the respective platforms being spaced apart to define a parallel walled valley, the floor of which is perforated with stud-receiving apertures, the closure including a spooning cap arranged for snap-fit engagement with said spooning platform and further including a sifting cap arranged for snap-fit engagement with said sifting platform, said closure still further including a strap hingedly interconnecting said caps and fittably engaging the floor of said valley, studs depending from said strap entering said apertures for securely fastening said closure to said dispenser, the improvement comprising: a first snap-fit protuberance extending from the edge of said spooning cap adjacent the valley wall thereof; means defining a niche in the valley wall of said spooning cap; a second snap-fit protuberance extending from the edge of said sifting cap adjacent the valley wall thereof and aligned with said spooning cap niche; and means defining a niche in the valley wall of said sifting cap aligned with said first snap-fit protuberance, whereby one or the other of said caps may be selectively raised and locked into dispenser opening condition with the protuberance thereof snap-fit into the niche in the opposite valley wall.

2. The improvement according to claim 1 wherein said niches are disposed at the root of the valley floor and the corresponding valley wall.

3. The improvement according to claim 1 wherein said protuberances are bar-shaped tongues and said niches are elongate recesses.

4. The improvement according to claim 1 wherein said protuberances and said niches are aligned substantially perpendicular to the sagittal plane of the dispenser body.

5. The improvement according to claim 1 wherein the height of the valley walls substantially equals the width of the valley floor whereby raising of one cap serves to lock the other cap over its corresponding platform so that only one platform can be revealed at a given time.

* * * * *